US010514622B2

(12) United States Patent
Washino

(10) Patent No.: US 10,514,622 B2
(45) Date of Patent: Dec. 24, 2019

(54) TONER

(71) Applicant: KYOCERA Document Solutions Inc., Osaka (JP)

(72) Inventor: Yusuke Washino, Osaka (JP)

(73) Assignee: KYOCERA Document Solutions, Osaka (JP)

( * ) Notice: Subject to any disclaimer, the term of this patent is extended or adjusted under 35 U.S.C. 154(b) by 0 days.

(21) Appl. No.: 16/240,989

(22) Filed: Jan. 7, 2019

(65) Prior Publication Data

US 2019/0250527 A1 Aug. 15, 2019

(30) Foreign Application Priority Data

Feb. 13, 2018 (JP) ..... 2018-023108

(51) Int. Cl.
*G03G 9/093* (2006.01)
*G03G 9/08* (2006.01)
*G03G 9/087* (2006.01)

(52) U.S. Cl.
CPC ..... *G03G 9/09342* (2013.01); *G03G 9/0821* (2013.01); *G03G 9/09328* (2013.01); *G03G 9/09371* (2013.01); *G03G 9/09385* (2013.01); *G03G 9/09392* (2013.01); *G03G 9/081* (2013.01); *G03G 9/0819* (2013.01); *G03G 9/08755* (2013.01)

(58) Field of Classification Search
CPC ..... G03G 9/0935; G03G 9/09385; G03G 9/09342; G03G 9/09328; G03G 9/093; G03G 9/09392; G03G 9/09371; G03G 9/09307
See application file for complete search history.

(56) References Cited

U.S. PATENT DOCUMENTS 4,540,644 A * 9/1985 Jacob ..... G03G 9/0926 427/195
6,165,667 A 12/2000 Takagi et al.

FOREIGN PATENT DOCUMENTS

JP 2000-13187 A 1/2000

OTHER PUBLICATIONS

Grant, R. & al, ed., Grant & Hackh's Chemical Dictionary,fifth edition, McGraw-Hill Book Company, NY (1987), p. 257. (Year: 1987) (Year: 1987).*

* cited by examiner

*Primary Examiner* — Janis L Dote
(74) *Attorney, Agent, or Firm* — Studebaker & Brackett PC

(57) ABSTRACT

A toner includes toner particles. Each of the toner particles includes a composite core and a shell layer covering a surface of the composite core. Each of the composite cores is a composite of a toner core and foamable particles provided on a surface of the toner core. An amount of the foamable particles is at least 0.3% by mass relative to mass of the toner cores. Each of the foamable particles includes a base particle and a coat layer covering a surface of the base particle. The base particles are non-foamable. The coat layers include a foamable group. The foamable group is bonded to the surfaces of the base particles through a bond including a bond represented by formula "—O—Si—".

5 Claims, 2 Drawing Sheets

TONER

INCORPORATION BY REFERENCE

The present application claims priority under 35 U.S.C. § 119 to Japanese Patent Application No. 2018-023108, filed on Feb. 13, 2018. The contents of this application are incorporated herein by reference in their entirety.

BACKGROUND

The present disclosure relates to a toner and more particularly to a capsule toner.

A known toner for example contains a foaming agent. A low-boiling substance is used as the foaming agent for the toner, and the toner foams through evaporation (i.e., vaporization) of the low-boiling substance in the toner.

SUMMARY

A toner according to an aspect of the present disclosure includes toner particles. Each of the toner particles includes a composite core and a shell layer covering a surface of the composite core. Each of the composite cores is a composite of a toner core and foamable particles provided on a surface of the toner core. An amount of the foamable particles is at least 0.3% by mass relative to mass of the toner cores. Each of the foamable particles includes a base particle and a coat layer covering a surface of the base particle. The base particles are non-foamable. The coat layers include a foamable group. The foamable group is bonded to the surfaces of the base particles through a bond including a bond represented by formula "—O—Si—".

DETAILED DESCRIPTION

Figure 1:
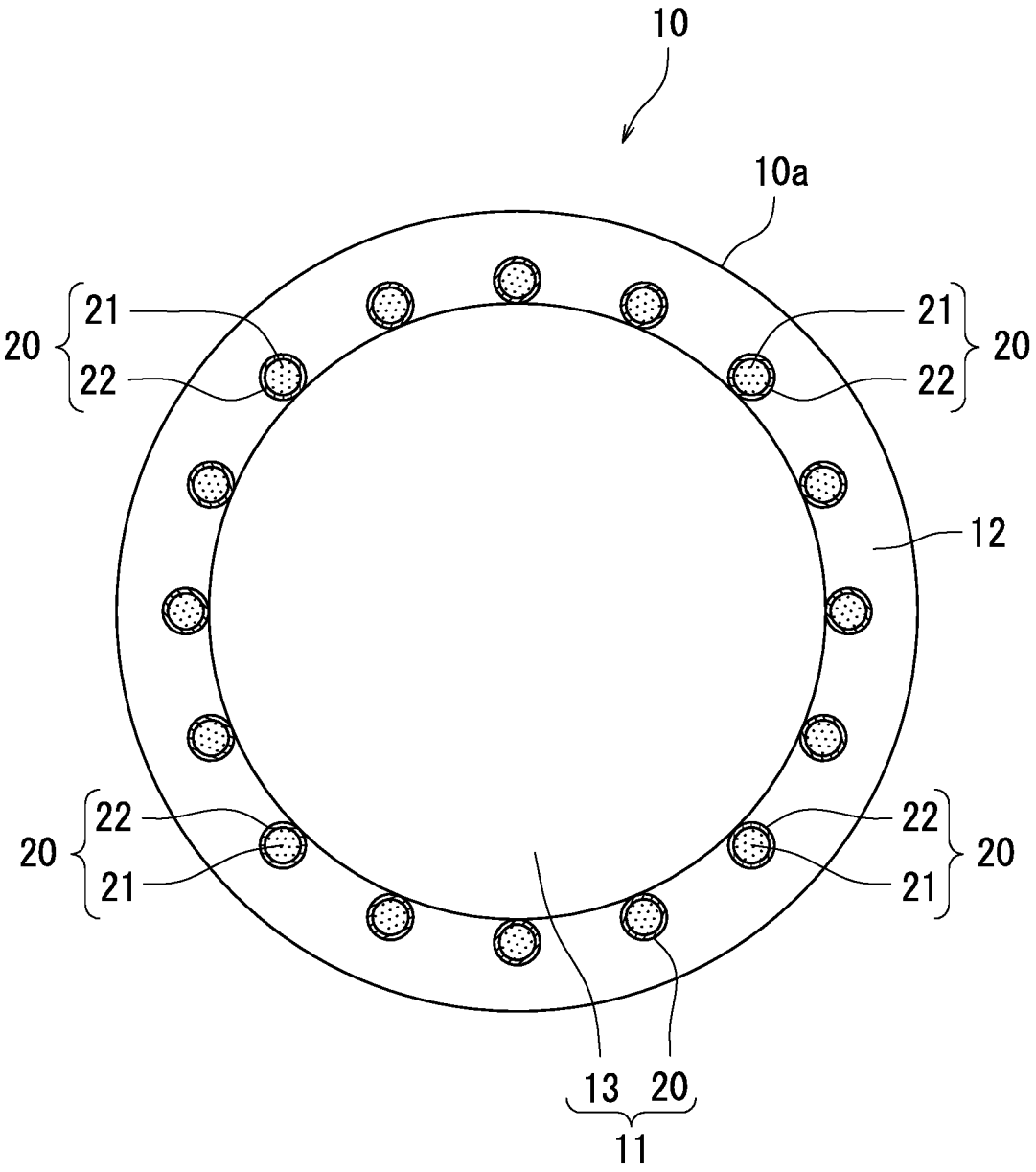
FIG. 1 is a diagram illustrating an example of a cross-sectional structure of a toner particle included in a toner according to an embodiment of the present disclosure.

The following describes an embodiment of the present disclosure. Unless otherwise stated, evaluation results (for example, values indicating shape and physical properties) for a powder (specific examples include toner cores, composite cores, foamable particles, toner mother particles, an external additive, and a toner) are each a number average of values measured for a suitable number of particles in the powder.

A number average particle diameter of a powder is a number average of equivalent circle diameters of primary particles (Heywood diameter: diameters of circles having the same areas as projected areas of the particles) measured using a microscope, unless otherwise stated. A value for a volume median diameter ($D_{50}$) of a powder is measured based on the Coulter principle (electrical sensing zone technique) using "Coulter Counter Multisizer 3", product of Beckman Coulter, Inc., unless otherwise stated.

A value for a glass transition point (Tg) is measured in accordance with "Japanese Industrial Standard (JIS) K7121-2012" using a differential scanning calorimeter ("DSC-6220", product of Seiko Instruments Inc.), unless otherwise stated. On a heat absorption curve (vertical axis: heat flow (DSC signal), horizontal axis: temperature) plotted for a sample using the differential scanning calorimeter, a temperature at a point of inflection caused due to glass transition corresponds to the glass transition point (Tg). Specifically, the temperature at a point of inflection caused due to glass transition is a temperature at an intersection point between an extrapolation of a base line and an extrapolation of an inclined portion of the curve.

A value for a softening point (Tm) is measured using a capillary rheometer ("CFT-500D", product of Shimadzu Corporation), unless otherwise stated. On an S-shaped curve (horizontal axis: temperature, vertical axis: stroke) plotted for a sample using the capillary rheometer, the softening point (Tm) is a temperature corresponding to a stroke value of "(base line stroke value+maximum stroke value)/2".

Strength of chargeability refers to ease of triboelectric charging through friction with a standard carrier provided by The Imaging Society of Japan, unless otherwise stated. A measurement target (for example, a toner) is triboelectrically charged by mixing and stirring the measurement target with a standard carrier (N-01 for an anionic measurement target, P-01 for a cationic measurement target) provided by The Imaging Society of Japan. Surface potential of the measurement target is measured before and after the triboelectric charging using for example a kelvin probe force microscope (KFM). A measurement target having a larger change in potential before and after the triboelectric charging has stronger chargeability.

Hereinafter, the term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof. The term "(meth)acryl" may be used as a generic term for both acryl and methacryl.

[Toner]

The present embodiment relates to a toner. The toner includes toner particles. The toner is a collection (powder) of the toner particles.

FIG. 1 illustrates an example of a cross-sectional structure of a toner particle 10 included in the toner according to the present embodiment. The toner particle 10 illustrated in FIG. 1 includes a composite core 11 and a shell layer 12. The shell layer 12 covers a surface of the composite core 11. The composite core 11 is a composite of a toner core 13 and foamable particles 20. The foamable particles 20 are provided on a surface of the toner core 13. The shell layer 12 for example covers the toner core 13 and the foamable particles 20. Specifically, the shell layer 12 covers surfaces of the foamable particles 20 and regions of the surface of the toner core 13 that are not provided with the foamable particles 20. The foamable particles 20 are located between (at a boundary between) the toner core 13 and the shell layer 12.

Each of the foamable particles 20 includes a base particle 21 and a coat layer 22. The coat layer 22 covers a surface of the base particle 21. The base particle 21 is non-foamable. The coat layer 22 includes a foamable group. The foamable group is bonded to the surface of the base particle 21 through a bond including a bond represented by formula "—O—Si—". The "bond including a bond represented by formula "—O—Si—"" is also referred to below as a "specific bond".

The toner according to the present embodiment has excellent low-temperature fixability and produces fewer ultrafine particles (UFPs). The reason for the above is thought to be as follows. In the toner according to the present embodiment, each composite core 11 has the foamable particles 20 on the surface thereof, and the shell layer 12 covers the surface of the composite core 11. That is, the foamable particles 20 are located between (at a boundary between) the toner core 13 and the shell layer 12. Like an eggshell, the shell layer 12 is resistant to pressure from the outside of the structure but is readily rupturable by pressure from the inside of the structure. The foamable group in the coat layer 22 of each foamable particle 20 foams through heating. Therefore, the foamable particles 20 foam through heating when the toner particles 10 are heated in a fixing step of image formation. As a result, pressure is applied to the inside of the shell layers 12, and the shell layers 12 are readily ruptured. Thus, the toner can have improved low-temperature fixability.

An amount of the foamable particles 20 is at least 0.3% by mass relative to mass of the toner cores 13. As a result of the amount of the foamable particles 20 being at least 0.3% by mass relative to mass of the toner cores 13, the shell layers 12 are readily rupturable by pressure applied to the inside of the shell layers 12 through foaming of the foamable particles 20. The toner can consequently have improved low-temperature fixability. In terms of improving low-temperature fixability of the toner, the amount of the foamable particles 20 relative to mass of the toner cores 13 is preferably at least 0.5% by mass, more preferably at least 0.8% by mass, still more preferably at least 1.0% by mass, even more preferably at least 1.1% by mass, further preferably at least 1.4% by mass, and particularly preferably at least 1.7% by mass. No particular limitations are placed on an upper limit of the amount of the foamable particles 20 relative to mass of the toner cores 13. For example, the amount can be no greater than 5.0% by mass.

The foamable group in the coat layer 22 of each foamable particle 20 is bonded to the surface of the base particle 21 through the specific bond. The inventor has found that the foamable particles 20 having such a structure tend not to produce ultrafine particles (UFPs), unlike low-molecular weight foaming agents such as 2,2'-azobis(N-butyl-2-methylpropionamide), p,p'-oxybis benzene sulfonyl hydrazide (OBSH), dinitrosopentamethylenetetramine (DPT), or azodicarbonamide (ADCA). Production of UFPs in image formation using the toner can be reduced through the toner particles 10 including the foamable particles 20 that tend not to produce UFPs. Note that the term UFPs means particles having a diameter of no greater than 0.1 μm. The toner that produces fewer UFPs is environment-friendly.

Preferably, the foamable particles 20 are not located inside of the toner cores 13. Preferably, the toner cores 13 do not contain the foamable particles 20. The foamable particles 20 in each toner particle are closer to the shell layer 12 in a structure in which the foamable particles 20 are located between the toner core 13 and the shell layer 12 than in a structure in which the foamable particles 20 are located inside of the toner core 13. Pressure to be applied to the inside of the shell layer 12 through the foaming can be increased by localizing the foamable particles 20 between the toner core 13 and the shell layer 12 without allowing the foamable particles 20 to be inside of the toner core 13. Thus, the toner can have improved low-temperature fixability.

Preferably, the foamable particles 20 are not located on an outermost surface 10*a* of the toner particle 10. Preferably, for example, the foamable particles 20 are not provided on the outermost surface 10*a* of the toner particle 10 as an external additive. As described above, the shell layer 12 is resistant to pressure from the outside of the structure. It is therefore possible to efficiently apply pressure to the inside of the shell layer 12 rather than to the outside of the shell layer 12 by preventing the foamable particles 20 from being located on the outermost surface 10*a* of the toner particle 10. Consequently, the shell layer 12 can be efficiently ruptured. In general, the foamable group is highly polar and therefore has an influence on the amount of charge of the toner. It is possible to reduce the influence of the foamable group on the amount of charge of the toner by covering the foamable particles 20 with the shell layer 12, and thus preventing the foamable particles 20 from being located on the outermost surface 10*a* of the toner particle 10. Furthermore, even in a composition in which the foamable particles 20 are highly moisture-absorbent, it is possible to prevent the amount of charge of the toner from being reduced due to moisture absorption by the foamable particles 20 by covering the foamable particles 20 with the shell layer 12. It is also possible to prevent denaturation of the foamable particles 20 even when the toner is stored for a long period of time by covering the foamable particles 20 of each toner particle 10 with the shell layer 12, and thus preventing the foamable particles 20 from being located on the outermost surface 10*a* of the toner particle 10. As a result, the amount of foaming that results from the foamable group can be maintained for a long period of time.

Preferably, the shell layer 12 covers an entire surface area of the composite core 11. More preferably, the shell layer 12 completely covers the entire surface area of the composite core 11. The larger the area of the composite core 11 covered with the shell layer 12 is, the more difficult it is for gas generated from the foamable particles 20 to escape from an area that is not covered with the shell layer 12. As a result of the shell layer 12 covering the entire surface area of the composite core 11, it is possible to efficiently apply pressure to the inside of the shell layer 12, and thus efficiently rupture the shell layer 12.

Through the above, the structure of the toner particle 10 included in the toner has been described with reference to FIG. 1. The following further describes the toner.

[First Foaming Amount of Toner]

Preferably, a first foaming amount of the toner is at least 3.0 mL. The first foaming amount is a volume of gas collected from 100 g of the toner. The first foaming amount means a foaming amount of the toner as a whole. As long as the first foaming amount of the toner is at least 3.0 mL, the foamable particles foam favorably to apply pressure to the inside of each shell layer, allowing the shell layer to be readily ruptured. Thus, the toner can have improved low-temperature fixability.

In terms of improving low-temperature fixability of the toner, the first foaming amount of the toner is preferably at least 5.0 mL, more preferably at least 6.0 mL, still more preferably at least 8.0 mL, and particularly preferably at least 10.0 mL. The first foaming amount of the toner can for example be no greater than 15.0 mL.

The first foaming amount of the toner can be adjusted by for example changing the amount of the foamable particles relative to mass of the toner cores. The first foaming amount of the toner increases with an increase in the amount of the foamable particles relative to mass of the toner cores.

The first foaming amount of the toner is measured according to a first method. The following describes the first method. According to the first method, a liquid at 30° C. containing 100 g of the toner is heated up to 120° C. at a rate of 1° C./minute. The temperature of the liquid is kept at 120° C. for 30 minutes. A volume $V_1$ of gas collected over the liquid during a period from when the heating is started at 30°

C. to when 30 minutes elapses after the temperature of the liquid has reached 120° C. is measured. The volume $V_1$ of gas measured as described above is taken to be the first foaming amount. The first method will be described in detail below in association with Examples.

[Second Foaming Amount of Toner]

Preferably, a second foaming amount of the toner according to the present embodiment is at least 80% by volume of the first foaming amount. The second foaming amount is a volume of gas collected from toluene-insoluble matter contained in 100 g of the toner. The second foaming amount substantially means a foaming amount of the foamable particles in the toner. A ratio of the second foaming amount to the first foaming amount substantially means a ratio of the foaming amount of the foamable particles in the toner to the foaming amount of the toner as a whole. A higher ratio of the second foaming amount to the first foaming amount indicates that a larger proportion of the foaming of the toner results from the foamable particles in the toner. The second foaming amount being at least 80% by volume of the first foaming amount means that a sufficiently large proportion of the foaming of the toner results from the foamable particles located right under the shell layers. Accordingly, pressure is efficiently applied to the inside of the shell layers, and the shell layers are readily ruptured. Thus, the toner can have improved low-temperature fixability.

More preferably, in terms of improving low-temperature fixability of the toner, the second foaming amount is at least 90% by volume of the first foaming amount, still more preferably at least 95% by volume of the first foaming amount, and particularly preferably 100% by volume of the first foaming amount.

The ratio of the second foaming amount to the first foaming amount can be adjusted by for example changing an amount of a foaming agent to be contained in the toner cores and the shell layers. Preferably, the toner cores and the shell layers contain no foaming agent.

The second foaming amount is measured according to a second method. The following describes the second method. According to the second method, toluene-insoluble matter is collected from 1 g of the toner. A liquid at 30° C. containing the collected toluene-insoluble matter is heated up to 120° C. at a rate of 1° C./minute. The temperature of the liquid is kept at 120° C. for 30 minutes. A volume $V_{2A}$ of gas collected over the liquid during a period from when the heating is started at 30° C. to when 30 minutes elapses after the temperature of the liquid has reached 120° C. is measured. A volume $V_2$ of gas obtained by multiplying the volume $V_{2A}$ of gas measured as described above by 100 is taken to be the second foaming amount. The second method will be described in detail below in association with Examples.

[Third Foaming Amount of Toner]

Preferably, a third foaming amount of the toner according to the present embodiment is less than 6% by volume of the first foaming amount. The third foaming amount is a volume of gas collected from tetrahydrofuran-soluble matter contained in 100 g of the toner. The third foaming amount substantially means a foaming amount of toner components other than the foamable particles. A ratio of the third foaming amount to the first foaming amount substantially means a ratio of the foaming amount of the toner components other than the foamable particles to the foaming amount of the toner as a whole. A lower ratio of the third foaming amount to the first foaming amount indicates that a smaller proportion of the foaming of the toner results from the toner components other than the foamable particles. The third foaming amount being less than 6% by volume of the first foaming amount means that the toner components other than the foamable particles substantially do not foam, and a sufficiently large proportion of the foaming of the toner results from the foamable particles located right under the shell layers. Accordingly, pressure is efficiently applied to the inside of the shell layers, and the shell layers are readily ruptured. Thus, the toner can have improved low-temperature fixability.

The ratio of the third foaming amount to the first foaming amount tends to exceed 6% by volume in a structure in which the foamable group is not bonded to the base particles through a chemical bond (for example, the specific bond). This is because the coat layers having the foamable group that is not bonded to the base particles through a chemical bond (for example, the specific bond) are soluble in tetrahydrofuran.

More preferably, in terms of improving low-temperature fixability of the toner, the third foaming amount is no greater than 5% by volume of the first foaming amount, still more preferably no greater than 4% by volume of the first foaming amount, even more preferably no greater than 3% by volume of the first foaming amount, and particularly preferably no greater than 2% by volume of the first foaming amount. The third foaming amount can for example be at least 0% by volume of the first foaming amount.

The ratio of the third foaming amount to the first foaming amount can be adjusted by for example changing an amount of a foaming agent to be contained in the toner cores and the shell layers. Preferably, the toner cores and the shell layers contain no foaming agent.

The third foaming amount is measured according to a third method. The following describes the third method. According to the third method, tetrahydrofuran-soluble matter is collected from 10 g of the toner. A liquid at 30° C. containing the collected tetrahydrofuran-soluble matter is heated up to 120° C. at a rate of 1° C./minute. The temperature of the liquid is kept at 120° C. for 30 minutes. A volume $V_{3A}$ of gas collected over the liquid during a period from when the heating is started at 30° C. to when 30 minutes elapses after the temperature of the liquid has reached 120° C. is measured. A volume $V_3$ of gas obtained by multiplying the volume $V_{3A}$ of gas by 10 is taken to be the third foaming amount. The third method will be described in detail below in association with Examples.

[Pre-Extraction Gas Volume $V_{4A}$ and Post-Extraction Gas Volume $V_{4B}$ from Foamable Particles]

In the case of the toner according to the present embodiment, a ratio ($V_{4B}/V_{4A}$) of a volume $V_{4B}$ of gas collected from the foamable particles subjected to extraction with tetrahydrofuran to a volume $V_{4A}$ of gas collected from the foamable particles prior to extraction with tetrahydrofuran is preferably at least 90% by volume and no greater than 100% by volume. The "volume of gas collected from the foamable particles prior to extraction with tetrahydrofuran" is also referred to below as a "pre-extraction gas volume", and the "volume of gas collected from the foamable particles subjected to extraction with tetrahydrofuran" is also referred to below as a "post-extraction gas volume". The pre-extraction gas volume $V_{4A}$ is equivalent to a volume of gas generated from the foamable particles before the tetrahydrofuran-soluble matter is removed. The post-extraction gas volume $V_{4B}$ is equivalent to a volume of gas generated from the foamable particles after the tetrahydrofuran-soluble matter has been removed. In a structure in which the foamable group in the coat layers of the foamable particles is not bonded to the base particles through a chemical bond (for example, the specific bond), the coat layers having the foamable group dissolve in tetrahydrofuran through the extraction with tetrahydrofuran. Accordingly, the post-extraction gas volume $V_{4B}$, which in this case a volume of gas generated from the foamable particles after the tetrahydrofuran-soluble matter (foamable group-containing matter) has been removed, is lower than the pre-extraction gas volume $V_{4A}$. As a result, a value of the ratio $V_{4B}/V_{4A}$ decreases. The ratio $V_{4B}/V_{4A}$ being at least 90% by volume indicates that most of the molecules of the foamable group are bonded to the surfaces of the base particles through a chemical bond (for example, the specific bond).

The ratio $V_{4B}/V_{4A}$ is measured according to a fourth method. The following describes the fourth method. According to the fourth method, a liquid at 30° C. containing 100 g of the foamable particles is heated up to 120° C. at a rate of 1° C./minute. The temperature of the liquid is kept at 120° C. for 30 minutes. A volume of gas collected over the liquid during a period from when the heating is started at 30° C. to when 30 minutes elapses after the temperature of the liquid has reached 120° C. is measured. The thus measured volume of gas is taken to be the pre-extraction gas volume $V_{4A}$.

Next, 100 g of the foamable particles are subjected to extraction with tetrahydrofuran at 75° C. for 18 hours using a Soxhlet extractor to obtain foamable particles subjected to extraction with tetrahydrofuran. A liquid at 30° C. containing the foamable particles subjected to extraction with tetrahydrofuran is heated up to 120° C. at a rate of 1° C./minute. The temperature of the liquid is kept at 120° C. for 30 minutes. A volume of gas collected over the liquid during a period from when the heating is started at 30° C. to when 30 minutes elapses after the temperature of the liquid has reached 120° C. is measured. The thus measured volume of gas is taken to be the post-extraction gas volume $V_{4B}$. The ratio $V_{4B}/V_{4A}$ is calculated in accordance with an expression "$100\times V_{4B}/V_{4A}$". The fourth method will be described in detail below in association with Examples.

[Foamable Particles of Composite Core]

Each composite core is a composite of a toner core and foamable particles provided on a surface of the toner core. Each foamable particle includes a base particle and a coat layer covering a surface of the base particle. The base particles are non-foamable. The base particles include no foamable group. The base particles contain no foaming agent. Preferably, the base particles are non-foamable inorganic particles, and more preferably silica particles.

The coat layers include a foamable group. Preferably, the foamable group is an azido group. The foamable particles for example generate nitrogen through an exothermic reaction of the azido group when the toner particles are heated. Specifically, upon heating, the azido group decomposes through an exothermic reaction represented by reaction formula "$—N_3 \rightarrow —N+N_2$" to generate nitrogen (specifically, nitrogen gas). In terms of improving low-temperature fixability of the toner, preferably, the exothermic reaction of the azido group occurs at 120° C. Nitrogen generated through the exothermic reaction of the azido group when the toner is heated at 120° C. facilitates adequate rupture of the shell layers in the fixing step. Once the exothermic reaction starts, heat is generated to accelerate the exothermic reaction of the azido group. In terms of improving heat-resistant preservability of the toner, preferably, the exothermic reaction of the azido group does not occur at a temperature of no greater than 60° C.

Compatibility between the foamable particles and other toner components can be improved through a composition in which an azido group is used as the foamable group compared to a composition in which an inorganic foaming agent such as sodium hydrogencarbonate is used. Furthermore, the composition in which an azido group is used as the foamable group tends not to generate carbon monoxide and ammonia. The foamable particles including an azido group as the foamable group are therefore environment-friendly.

The foamable group is bonded to the surfaces of the base particles through the specific bond. The foamable particles are for example formed by treating the surfaces of the base particles with a foamable group-containing alkoxysilane. As a result of the surface treatment of the base particles with the foamable group-containing alkoxysilane, alkoxy groups included in the foamable group-containing alkoxysilane form hydroxyl groups through hydrolysis. Some of the hydroxyl groups formed through the hydrolysis are bonded to each other to form a silanol bond. Other ones react with hydroxyl groups present on the surfaces of the base particles (a dehydration reaction). The specific bond is formed between the base particles and the foamable group through the dehydration reaction. Each coat layer having the foamable group bonded to the surface of the corresponding base particle through the bond including a bond represented by formula "—O—Si—" is equivalent to a silane coupling agent treatment layer having the foamable group.

Examples of foamable group-containing alkoxysilanes include an alkoxysilane represented by formula (2) shown below (also referred to below as an alkoxysilane (2)).

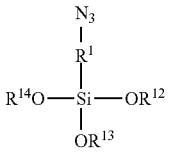

(2)

In formula (2), $R^1$ represents an alkylene group. $R^{12}$, $R^{13}$, and $R^{14}$ each represent, independently of one another, an alkyl group.

The alkylene group represented by $R^1$ is preferably an alkylene group having a carbon number of at least 1 and no greater than 15, more preferably an alkylene group having a carbon number of at least 1 and no greater than 6, still more preferably a propylene group, and even more preferably an n-propylene group. The alkylene group represented by $R^1$ may be a straight chain alkylene group or a branched chain alkylene group.

The alkyl group represented by $R^{12}$, $R^{13}$, and $R^{14}$ is preferably an alkyl group having a carbon number of at least 1 and no greater than 6, more preferably an alkyl group having a carbon number of at least 1 and no greater than 3, and still more preferably a methyl group.

In formula (2), preferably, $R^1$ represents a propylene group, and $R^{12}$, $R^{13}$, and $R^{14}$ each represent a methyl group.

Figure 2:
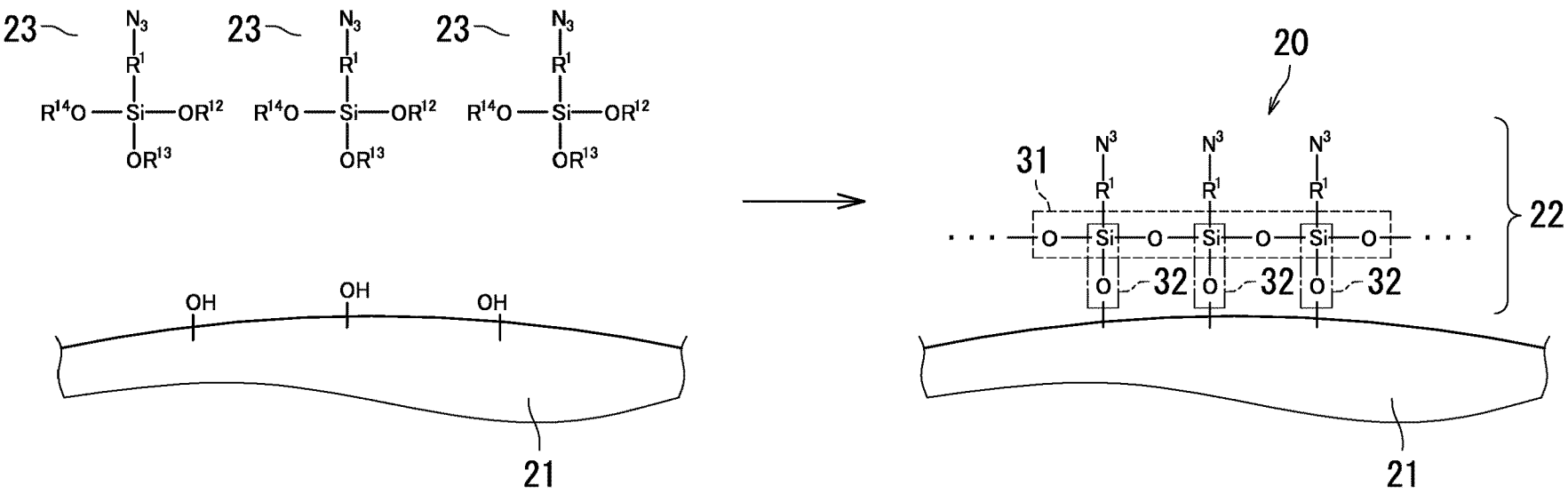
FIG. 2 is a diagram schematically illustrating an example of a reaction between base particles and an alkoxysilane having a foamable group.

The following describes an example of a reaction between an alkoxysilane 23 having a foamable group and the base particles 21 with reference to FIG. 2. The alkoxysilane 23 in FIG. 2 is the alkoxysilane (2). As a result of surface treatment of the base particles 21 with the alkoxysilane 23, alkoxy groups included in the alkoxysilane 23 (more specifically, $OR^{12}$, $OR^{13}$, and $OR^{14}$ groups) form hydroxyl groups through hydrolysis. Some of the hydroxyl groups formed through the hydrolysis are bonded to each other to form a silanol bond 31. Other ones react with hydroxyl groups present on the surfaces of the base particles 21 (a dehydration reaction). Through the above, the specific bond including a bond 32 represented by formula "—O—Si—" is formed. The specific bond is for example a bond represented by formula "—O—Si—$R^1$—". The foamable group (for example, an azido group) is bonded to the surfaces of the base particles 21 through the bond including the bond 32 represented by formula "—O—Si—" (the bond represented by formula "—O—Si—$R^1$—"). As a result, a structure represented by formula (1) shown below is formed. Thus, the coat layers 22 can include the structure represented by formula (1) shown below.

(1)

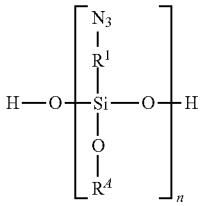

In formula (1), $R^1$ represents an alkylene group. n represents a repeating number of a repeating unit in the structure. $R^A$ represents a bond bonded to an atom composing the base particles 21. Examples of preferable groups that may be represented by $R^1$ in formula (1) are the same as the examples of preferable groups that may be represented by $R^1$ in formula (2).

The coat layers 22 including the structure represented by formula (1) include at least a structure represented by formula (1-1) shown below.

(1-1)

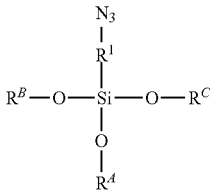

In formula (1-1), $R^1$ represents an alkylene group. $R^A$ represents a bond bonded to an atom composing the base particles 21. $R^B$ and $R^C$ each represent, independently of one another, a hydrogen atom or a bond bonded to a silicon atom in the coat layers 22. Examples of preferable groups that may be represented by $R^1$ in formula (1-1) are the same as the examples of preferable groups that may be represented by $R^1$ in formula (2). Through the above, an example of the reaction between the alkoxysilane 23 having the foamable group and the base particles 21 has been described with reference to FIG. 2.

The following method may be alternatively employed instead of treating the surfaces of the base particles with a foamable group-containing alkoxysilane. First, the surfaces of the base particles are treated with a halogen group-containing alkoxysilane. As a result, alkoxy groups included in the halogen group-containing alkoxysilane form hydroxyl groups through hydrolysis. Some of the hydroxyl groups formed through the hydrolysis are bonded to each other to form a silanol bond. Other ones react with hydroxyl groups present on the surfaces of the base particles (a dehydration reaction). Next, a reaction between the halogen group from the alkoxysilane and a foamable group-containing salt is caused. Through this reaction, the halogen group is eliminated and the foamable group is introduced to form the specific bond between the base particles and the foamable group.

Examples of halogen group-containing alkoxysilanes include an alkoxysilane represented by formula (31 shown below (also referred to below as an alkoxysilane (3)).

(3)

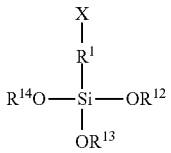

In formula (3), $R^1$ represents an alkylene group. $R^{12}$, $R^{13}$, and $R^{14}$ each represent, independently of one another, an alkyl group. X represents a halogen group.

Examples of preferable groups that may be represented by $R^1$, $R^{12}$, $R^{13}$, and $R^{14}$ in formula (3) are the same as the examples of preferable groups that may be represented by $R^1$, $R^{12}$, $R^{13}$, and $R^{14}$ in formula (2). The halogen group represented by X is preferably a fluoro group, a chloro group, a bromo group, or an iodo group, and more preferably a chloro group.

As a result of surface treatment of the base particles with the alkoxysilane (3), alkoxy groups included in the alkoxysilane (3) (more specifically, $OR^{12}$, $OR^{13}$, and $OR^{14}$ groups) form hydroxyl groups through hydrolysis. Some of the hydroxyl groups formed through the hydrolysis are bonded to each other to form a silanol bond. Other ones react with hydroxyl groups present on the surfaces of the base particles (a dehydration reaction). As a result, a structure represented by formula (4) shown below is formed.

(4)

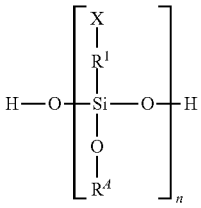

In formula (4), $R^1$ represents an alkylene group. n represents a repeating number of a repeating unit in the structure. $R^A$ represents a bond bonded to an atom composing the base particles. X represents a halogen group. Examples of preferable groups that may be represented by $R^1$ in formula (4) are the same as the examples of preferable groups that may be represented by $R^1$ in formula (2). Examples of preferable groups that may be represented by X in formula (4) are the same as the examples of preferable groups that may be represented by X in formula (3).

Next, the base particles subjected to the surface treatment with the alkoxysilane (3) are further treated with a foamable group-containing salt (for example, sodium azide). Through the above, X in formula (4) is eliminated and an azido group is introduced. As a result, the structure represented by formula (1) is formed. Thus, the coat layers can include the structure represented by formula (1). In a situation in which the base particles are treated using 3-chloropropyltrimethoxysilane and sodium azide, for example, $R^1$ in formula (1) represents an n-propylene group.

[Toner Core of Composite Core]

The toner cores may for example contain at least one of a binder resin, a colorant, a releasing agent, a charge control agent, and a magnetic powder. Preferably, the component of the toner cores (for example, at least one of a binder resin, a colorant, a releasing agent, a charge control agent, and a magnetic powder) has no foamable group. Preferably, the component of the toner cores (for example, at least one of a binder resin, a colorant, a releasing agent, a charge control agent, and a magnetic powder) contains no foaming agent.

(Binder Resin)

Examples of binder resins that can be used include styrene-based resins, acrylic acid-based resins (specific examples include acrylic acid ester polymers and methacrylic acid ester polymers), olefin-based resins (specific examples include polyethylene resins and polypropylene resins), vinyl chloride resins, polyvinyl alcohols, vinyl ether resins, N-vinyl resins, polyester resins, polyamide resins, and urethane resins. Copolymers of the resins listed above, that is, copolymers obtained through incorporation of a repeating unit into any of the resins listed above (specific examples include a styrene-acrylic acid-based resin and a styrene-butadiene-based resin) may also be used. The toner cores may contain only one binder resin or may contain two or more (for example, three) binder resins.

A polyester resin is obtained through polycondensation or condensation copolymerization of an alcohol monomer and a carboxylic acid monomer. The polyester resin is a polymer of the alcohol monomer and the carboxylic acid monomer.

Examples of alcohol monomers that can be used include diol monomers, bisphenol monomers, and tri- or higher-hydric alcohol monomers.

Examples of diol monomers that can be used include ethylene glycol, diethylene glycol, triethylene glycol, 1,2-propanediol, 1,3-propanediol, 1,4-butanediol, neopentyl glycol, 2-butene-1,4-diol, 1,5-pentanediol, 1,6-hexanediol, 1,4-cyclohexanedimethanol, dipropylene glycol, polyethylene glycol, polypropylene glycol, and polytetramethylene glycol.

Examples of bisphenol monomers that can be used include bisphenol A, hydrogenated bisphenol A, bisphenol A ethylene oxide adducts, and bisphenol A propylene oxide adducts (for example, an adduct of bisphenol A with 2 moles of propylene oxide).

Examples of tri- or higher-hydric alcohol monomers that can be used include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of carboxylic acid monomers that can be used include dibasic carboxylic acid monomers, and tri- and higher-basic carboxylic acid monomers.

Examples of dibasic carboxylic acid monomers that can be used include maleic acid, fumaric acid, citraconic acid, itaconic acid, glutaconic acid, phthalic acid, isophthalic acid, terephthalic acid, 5-sulfoisophthalic acid, 5-sodium sulfoisophthalic acid, cyclohexanedicarboxylic acid, adipic acid, sebacic acid, azelaic acid, malonic acid, succinic acid, alkyl succinic acids, and alkenyl succinic acids. Examples of alkyl succinic acids that can be used include n-butylsuccinic acid, isobutylsuccinic acid, n-octylsuccinic acid, n-dodecylsuccinic acid, and isododecylsuccinic acid. Examples of alkenyl succinic acids that can be used include n-butenylsuccinic acid, isobutenylsuccinic acid, n-octenylsuccinic acid, n-dodecenylsuccinic acid, and isododecenylsuccinic acid.

Examples of tri- and higher-basic carboxylic acid monomers that can be used include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

Only one alcohol monomer may be used, or two or more alcohol monomers may be used in combination. Only one carboxylic acid monomer may be used, or two or more carboxylic acid monomers may be used in combination. Alternatively, an ester-forming derivative of a carboxylic acid monomer may be used. Examples of ester-forming derivatives that can be used include acid halides, acid anhydrides, and lower alkyl esters. Examples of lower alkyls include an alkyl group having a carbon number of at least 1 and no greater than 6.

Preferably, the polyester resin has a glass transition point (Tg) of at least 30° C. and no greater than 80° C. The toner cores may contain two or more (for example, three) polyester resins each having a different glass transition point. In a composition of the toner cores containing first to third polyester resins each having a different glass transition point, the first polyester resin preferably has a glass transition point of at least 30° C. and no greater than 45° C., the second polyester resin preferably has a glass transition point of at least 50° C. and no greater than 60° C., and the third polyester resin preferably has a glass transition point of at least 65° C. and no greater than 80° C.

Preferably, the polyester resin has a softening point (Tm) of at least 60° C. and no greater than 130° C. The toner cores may contain two or more (for example, three) polyester resins each having a different softening point. In a composition of the toner cores containing first to third polyester resins each having a different softening point, the first polyester resin preferably has a softening point of at least 60° C. and no greater than 75° C., the second polyester resin preferably has a softening point of at least 80° C. and no greater than 100° C., and the third polyester resin preferably has a softening point of at least 110° C. and no greater than 130° C.

(Colorant)

A known pigment or dye matching a color of the toner can be used as a colorant. In order to obtain a toner suitable for image formation, the amount of the colorant is preferably at least 1% by mass and no greater than 20% by mass relative to mass of the toner cores.

The toner cores may contain a black colorant. Carbon black can for example be used as a black colorant. Alternatively, a colorant that is adjusted to a black color using a yellow colorant, a magenta colorant, and a cyan colorant can be used as a black colorant.

The toner cores may contain a non-black colorant. Examples of non-black colorants that can be used include a yellow colorant, a magenta colorant, and a cyan colorant.

The yellow colorant that can be used is for example at least one compound selected from the group consisting of condensed azo compounds, isoindolinone compounds, anthraquinone compounds, azo metal complexes, methine compounds, and arylamide compounds. Examples of yellow colorants that can be used include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), Naphthol Yellow S, Hansa Yellow G, and C.I. Vat Yellow.

The magenta colorant that can be used is for example at least one compound selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Examples of magenta colorants that can be used include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, or 254).

The cyan colorant that can be used is for example at least one compound selected from the group consisting of copper phthalocyanine compounds, anthraquinone compounds, and basic dye lake compounds. Examples of cyan colorants that can be used include C.I. Pigment Blue (1, 7, 15, 15:1, 15:2, 15:3, 15:4, 60, 62, or 66), Phthalocyanine Blue, C.I. Vat Blue, and C.I. Acid Blue.

(Releasing Agent)

The releasing agent is for example used in order to improve fixability or offset resistance of the toner. In order to improve fixability or offset resistance of the toner, the amount of the releasing agent is preferably at least 0.1 parts by mass and no greater than 30 parts by mass relative to 100 parts by mass of the binder resin.

Examples of releasing agents that can be used include: aliphatic hydrocarbon waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon waxes such as polyethylene oxide wax and block copolymer of polyethylene oxide wax; plant waxes such as candelilla wax, carnauba wax, Japan wax, jojoba wax, and rice wax; animal waxes such as beeswax, lanolin, and spermaceti; mineral waxes such as ozocerite, ceresin, and petrolatum; waxes having a fatty acid ester as a main component such as montanic acid ester wax and castor wax; and waxes in which a part or all of a fatty acid ester has been deoxidized such as deoxidized carnauba wax. The toner cores may contain only one releasing agent or may contain two or more releasing agents. Preferably, the releasing agent is an ester wax.

(Charge Control Agent)

The toner cores may contain a charge control agent. The charge control agent is for example used in order to improve charge stability and a charge rise characteristic of the toner. The charge rise characteristic of the toner is an indicator as to whether the toner can be charged to a specific charge level in a short period of time.

The anionic strength of the toner cores can be increased through the toner cores containing a negatively chargeable charge control agent (specific examples include organic metal complexes and chelate compounds). The cationic strength of the toner cores can be increased through the toner cores containing a positively chargeable charge control agent (specific examples include pyridine, nigrosine, and quaternary ammonium salts). Preferably, the charge control agent is nigrosine. However, when it is possible to ensure that the toner has sufficient chargeability, the toner cores do not need to contain a charge control agent.

(Magnetic Powder)

The toner cores may contain a magnetic powder. Examples of materials of the magnetic powder that can be used include ferromagnetic metals (specific examples include iron, cobalt, nickel, and alloys of any one or more of the aforementioned metals), ferromagnetic metal oxides (specific examples include ferrite, magnetite, and chromium dioxide), and materials subjected to ferromagnetization (specific examples include carbon materials made ferromagnetic through thermal treatment). One magnetic powder may be used independently, or two or more magnetic powders may be used in combination.

In order to inhibit elution of metal ions (for example, iron ions) from the magnetic powder, surface treatment is preferably performed on the magnetic powder. In a situation in which the shell layers are formed on the surfaces of the composite cores under acidic conditions, elution of metal ions to the surfaces of the toner cores included in the composite cores causes the composite cores to adhere to one another more readily. Inhibiting elution of metal ions from the magnetic powder is thought to inhibit the composite cores from adhering to one another.

[Shell Layer]

Preferably, the shell layers contain a resin. More preferably, the shell layers contain only a resin. The "resin contained in the shell layers" is also referred to below as a "shell resin". Preferably, the shell layers are substantially composed of the shell resin. In order that the shell layers are favorably ruptured by gas generated from the foamable particles, preferably, the shell layers are sufficiently hard. Therefore, the shell resin is preferably a thermosetting resin. Unlike thermoplastic resins, thermosetting resins do not soften through heating. Shell layers containing a thermosetting resin tend to remain hard even when heated in the fixing step and tend to be quickly ruptured by gas generated from the foamable particles. The toner can therefore be fixed to a recording medium smoothly even in high-speed printing.

Examples of thermosetting resins that can be used include aminoaldehyde resins, polyimide resins (specific examples include maleimide polymers and bismaleimide polymers), xylene-based resins, and vinyl resins (specific examples include a copolymer of at least two vinyl compounds). Examples of aminoaldehyde resins that can be used include melamine-based resins, urea-based resins, sulfonamide-based resins, glyoxal-based resins, guanamine-based resins, and aniline-based resins.

Preferably, the shell resin is a vinyl resin. Examples of preferable vinyl resins include a homopolymer of a monomer including a vinyl compound represented by formula (5) shown below and a copolymer of two or more monomers including the vinyl compound represented by formula (5). The vinyl compound represented by formula (5) is also referred to below as a "vinyl compound (5)".

(5)

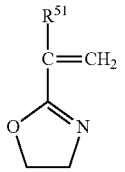

In formula (5), $R^{51}$ represents a hydrogen atom or an alkyl group optionally substituted with a substituent. For example, the alkyl group represented by $R^{51}$ is preferably an alkyl group having a carbon number of at least 1 and no greater than 6, and more preferably a methyl group, an ethyl group, or an isopropyl group. In a situation in which $R^{51}$ represents an alkyl group optionally substituted with a substituent, the substituent is for example a phenyl group. $R^{51}$ is preferably a hydrogen atom, a methyl group, an ethyl group, or an isopropyl group, and more preferably a hydrogen atom. Preferably, the vinyl compound (5) is 2-vinyl-2-oxazoline, for example.

The shell layers containing a homopolymer of a monomer including the vinyl compound (5) or a copolymer of monomers including the vinyl compound (5) include at least a repeating unit represented by formula (6) shown below. $R^{51}$ in formula (6) is the same as defined for $R^{51}$ in formula (5).

(6)

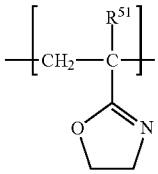

Examples of more preferable vinyl resins include a copolymer of the vinyl compound (5) and at least one vinyl compound that is not the vinyl compound (5). Examples of vinyl compounds that are not the vinyl compound (5) include ethylene, propylene, butadiene, vinyl chloride, (meth)acrylic acid, (meth)acrylic acid esters (preferable examples include alkyl (meth)acrylates), acrylonitrile, and styrene. The vinyl compound that is not the vinyl compound (5) is preferably an alkyl (meth)acrylate, more preferably methyl (meth)acrylate or ethyl (meth)acrylate, and still more preferably methyl methacrylate. The use of an alkyl (meth) acrylate tends to improve coverage by the shell layers.

A mass ratio between the vinyl compound (5) and the vinyl compound that is not the vinyl compound (5) is preferably at least 8.0/2.0 and no greater than 9.5/0.5, and more preferably 9.0/1.0.

Preferably, the shell layers contain a copolymer of monomers including the vinyl compound (5) and an alkyl (meth) acrylate. More preferably, the shell layers only contain a copolymer of monomers including the vinyl compound (5) and an alkyl (meth)acrylate. Monomers are raw materials of the shell resin. Only the vinyl compound (5) and an alkyl (meth)acrylate may be used as the monomers, which are raw materials of the shell resin. A different compound may be used in addition to the vinyl compound (5) and an alkyl (meth)acrylate as one of the monomers, which are raw materials of the shell resin.

In order to form such vinyl resin-containing shell layers, for example, an aqueous solution of an oxazoline group-containing polymer ("EPOCROS (registered Japanese trademark) WS series", product of Nippon Shokubai Co., Ltd.) can be used. "EPOCROS WS-300" contains a copolymer of 2-vinyl-2-oxazoline and methyl (meth)acrylate. "EPOCROS WS-700" contains a copolymer of 2-vinyl-2-oxazoline and methyl (meth)acrylate.

[External Additive]

The toner particles may have an external additive. The term "toner mother particles" may be used to refer to "shell layer-covered composite cores prior to treatment with an external additive". In a situation in which the treatment with an external additive is omitted, the toner mother particles are equivalent to toner particles. An external additive is optionally added to surfaces of the toner mother particles. Unlike internal additives, the external additive is not to be present inside of the toner mother particles but to be selectively present only on the surfaces of the toner mother particles (surface portions of the toner particles). For example, external additive particles (powder) can be caused to adhere to the surfaces of the toner mother particles by stirring the toner mother particles (powder) and the external additive together. The toner mother particles and the external additive particles do not chemically react with one another and are physically, not chemically, connected to one another. Strength of the connection between the toner mother particles and the external additive particles can be adjusted depending on stirring conditions (specific examples include stirring time and rotational speed for stirring), the particle diameter of the external additive particles, the shape of the external additive particles, and a surface condition of the external additive particles.

In order to allow the external additive to sufficiently exhibit its function while preventing detachment of the external additive particles from the toner particles, the amount of the external additive (in a situation in which two or more types of external additive particles are used, a total amount of the external additive particles) is preferably at least 0.5 parts by mass and no greater than 10 parts by mass relative to 100 parts by mass of the toner mother particles.

Preferably, the external additive particles are inorganic particles. Particularly preferably, the external additive particles are silica particles or particles of a metal oxide (specific examples include alumina, titanium oxide, magnesium oxide, zinc oxide, strontium titanate, and barium titanate). Particles of an organic acid compound such as a fatty acid metal salt (specific examples include zinc stearate) or resin particles may also be used as the external additive particles. One type of external additive particles may be used independently, or two or more types of external additive particles may be used in combination.

The toner according to the present embodiment is for example a positively chargeable toner that can be used in development of electrostatic latent images. The toner according to the present embodiment is a powder including the toner particles. The toner may be used as a one-component developer. Alternatively, a two-component developer may be prepared by mixing the toner and a carrier using a mixer (specific examples include a ball mill). In order to form high-quality images using the toner, preferably, the amount of the toner in the two-component developer is at least 5 parts by mass and no greater than 15 parts by mass relative to 100 parts by mass of the carrier. Preferably, the carrier has a number average primary particle diameter of at least 20 μm and no greater than 120 μm. In the case of a two-component developer including a positively chargeable toner and a carrier, the positively chargeable toner is positively charged by friction with the carrier. In order to form high-quality images using the toner, preferably, the toner has a volume median diameter ($D_{50}$) of at least 4 μm and no greater than 9 μm.

The following describes a toner production method according to the present embodiment. The toner production method includes a toner core formation process, a composite core formation process, and a shell layer formation process.

The following describes the toner core formation process. Examples of preferable methods for forming the toner cores include a pulverization method and an aggregation method. Toner cores obtained by the pulverization method are classified as being pulverized toner cores. Toner cores obtained by the aggregation method are classified as being polymerized toner cores. Preferably, the toner cores of the toner according to the present embodiment are pulverized toner cores.

The following describes an example of the pulverization method. First, at least one of a binder resin, a colorant, a charge control agent, a releasing agent, and a magnetic powder is mixed to obtain a mixture. The mixture is melt-kneaded using a melt-kneader (for example, a single- or twin-screw extruder) to obtain a kneaded product. The kneaded product is pulverized and classified. Through the above, toner cores having a desired particle diameter are obtained.

The following describes an example of the aggregation method. First, particles of at least one of a binder resin, a colorant, a charge control agent, a releasing agent, and a magnetic powder are caused to aggregate in an aqueous medium containing the aforementioned particles. Through the above, aggregates are formed. The aggregates are heated to cause components of the aggregates to coalesce. Through the above, toner cores having a desired particle diameter are obtained.

The following describes the composite core formation process. In the composite core formation process, the toner cores and the foamable particles are mixed. As a result, the foamable particles adhere to the surfaces of the toner cores, and thus composite cores are obtained.

The following describes the shell layer formation process. Examples of methods for forming the shell layers include in-situ polymerization, in-liquid curing film coating, and coacervation. More specifically, the composite cores are put in a liquid (for example, an aqueous medium) having a material for forming the shell layers (referred to below as a shell material) dissolved therein. Subsequently, the liquid is heated to promote a polymerization reaction of the shell material. Through the above, the shell layers are formed on the surfaces of the composite cores.

Resin particles (for example, a resin dispersion) may be used as the shell material in the shell layer formation. More specifically, the resin particles are caused to adhere to the surfaces of the composite cores in a liquid (for example, an aqueous medium) containing the resin particles and the composite cores. Subsequently, the liquid is heated to promote formation of films of the resin particles. Through the above, the shell layers are formed on the surfaces of the composite cores. Bonding between the resin particles (consequently, a cross-linking reaction in the resin particles) can be promoted on the surfaces of the composite cores while the liquid is kept at a high temperature.

The aqueous medium is a medium containing water as a main component (specific examples include water and a liquid mixture of water and a polar medium). Examples of polar media that can be used in the aqueous medium include alcohols (specific examples include methanol and ethanol). The aqueous medium for example has a boiling point of 100° C. Through the above, the toner production method according to the present embodiment has been described.

EXAMPLES

The following describes Examples of the present disclosure. Table 1 shows toners TA-1 to TA-6 and TB-1 to TB-8 according to Examples and Comparative Examples. Table 2 shows non-foamable particles A, foamable particles B, and foamable particles C that were used in production of the toners shown in Table 1. Note that the term "room temperature" used herein means "25° C.".

TABLE 1

| | Particles | | 1st foaming amount | 2nd foaming amount | $V_2/V_1$ | 3rd foaming amount | $V_3/V_1$ |
|---|---|---|---|---|---|---|---|
| Toner | Type | Amount [% by mass] | $V_1$ [mL/100 g] | $V_2$ [mL/100 g] | [% by volume] | $V_3$ [mL/100 g] | [% by volume] |
| TA-1 | B | 2.0 | 12.0 | 11.0 | 92 | 0.4 | 3 |
| TA-2 | B | 1.7 | 10.0 | 10.0 | 100 | 0.3 | 3 |
| TA-3 | B | 1.4 | 8.0 | 8.0 | 100 | 0.4 | 5 |
| TA-4 | B | 1.1 | 6.0 | 5.0 | 83 | 0.1 | 2 |
| TA-5 | B | 0.8 | 5.0 | 5.0 | 100 | 0.2 | 4 |
| TA-6 | B | 0.5 | 3.0 | 3.0 | 100 | 0.1 | 3 |
| TB-1 | B | 0.1 | 0.5 | 0.3 | 60 | 0.0 | 0 |
| TB-2 | A | 2.0 | 0.0 | 0.0 | — | 0.0 | — |
| TB-3 | A | 1.7 | 0.0 | 0.0 | — | 0.0 | — |
| TB-4 | A | 1.4 | 0.0 | 0.0 | — | 0.0 | — |
| TB-5 | A | 1.1 | 0.0 | 0.0 | — | 0.0 | — |
| TB-6 | A | 0.8 | 0.0 | 0.0 | — | 0.0 | — |
| TB-7 | A | 0.5 | 0.0 | 0.0 | — | 0.0 | — |
| TB-8 | C | 0.5 | 3.0 | 2.6 | 87 | 2.1 | 70 |

TABLE 2

| | Base particles | | Coat layer | | | $V_{4B}/V_{4A}$ |
|---|---|---|---|---|---|---|
| Particles | Material | Foamable/ Non-foamable | Material | Foamable group | Specific bond | [% by volume] |
| A | Silica | Non-foamable | 3-chloropropyl trimethoxysilane | Absent | Absent | — |
| B | Silica | Non-foamable | 3-chloropropyl trimethoxysilane/ sodium azide | Present | Present | 91 |
| C | Silica | Non-foamable | 2,2'-azobis(N-butyl-2-methyl propionamide) | Present | Absent | 23 |

"Particles" in Table 1 mean foamable particles or non-foamable particles. "Amount" in Table 1 means an amount (unit: % by mass) of the foamable particles or the non-foamable particles contained in the composite cores relative to mass of the toner cores. The unit "mL/100 g" in Table 1 means a foaming amount (unit: mL) in terms of 100 g of the toner. "$V_2/V_1$" in Table 1 means a percentage (unit: % by volume) of the second foaming amount relative to the first foaming amount. "$V_2/V_1$" in Table 1 can be calculated in accordance with an expression "$100\times V_2/V_1$". "$V_3/V_1$" in Table 1 means a percentage (unit: % by volume) of the third foaming amount relative to the first foaming amount. "$V_3/V_1$" in Table 1 can be calculated in accordance with an expression "$100\times V_3/V_1$".

"Particles" in Table 2 mean foamable particles or non-foamable particles. "Non-foamable" in the column titled "Foamable/Non-foamable" under the "Base particles" in Table 2 indicates that the base particles were non-foamable. "Present" in the column titled "Foamable group" under the "Coat layer" in Table 2 indicates that the coat layers included a foamable group. "Absent" in the column titled "Foamable group" under the "Coat layer" in Table 2 indicates that the coat layers included no foamable group. "Present" in the column titled "Specific bond" in Table 2 indicates that the foamable group was bonded to the surfaces of the base particles through the specific bond. "Absent" in the column titled "Specific bond" in Table 2 indicates that the foamable group was not bonded to the surfaces of the base particles through the specific bond. "$V_{4B}/V_{4A}$" in Table 2 means a ratio of the post-extraction gas volume $V_{4B}$ to the pre-extraction gas volume $V_{4A}$ ($V_{4B}/V_{4A}$, unit: % by volume).

The following describes production methods, measurement methods, evaluation methods, and evaluation results of the toners TA-1 to TA-6 and TB-1 to TB-8. In evaluations in which errors might occur, an evaluation value was calculated by obtaining an appropriate number of measured values and calculating the arithmetic mean of the measured values in order to ensure that any errors were sufficiently small.

[Toner Production Method]

<Process of Forming Foamable Particles or Non-Foamable Particles>

The non-foamable particles A, the foamable particles B, and the foamable particles C were prepared according to methods described below.

(Non-Foamable Particles A)

A reaction vessel equipped with a stirrer was charged with 100 g of positively chargeable silica particles ("AEROSIL (registered Japanese trademark) REA90", product of Nippon Aerosil Co., Ltd., dry silica particles made positively chargeable through surface treatment, number average primary particle diameter: approximately 20 nm), 10 g of 3-chloropropyltrimethoxysilane, 15 g of acetic acid, 50 g of pure water, and 500 g of isopropyl alcohol, and the reaction vessel contents were stirred. The reaction vessel contents were caused to react at room temperature for 48 hours. A solid was collected from the reaction vessel through filtration. The collected solid was washed with isopropyl alcohol and vacuum-dried at 40° C. As a result, the non-foamable particles A (a powder including a large number of non-foamable particles A) were obtained. The non-foamable particles A included silica particles, which were the base particles, and the coat layers. The coat layers were surface treatment layers obtained by treating the surfaces of the base particles using 3-chloropropyltrimethoxysilane. The coat layers included no foamable group (for example, an azido group).

(Foamable Particles B)

A reaction vessel equipped with a stirrer was charged with 20 g of the non-foamable particles A, 5 g of sodium azide, and 100 mL of purified water, and the reaction vessel contents were stirred at room temperature for 48 hours. A solid was collected from the reaction vessel through filtration. The collected solid was washed with purified water three times. The washed solid was vacuum-dried at 40° C. As a result, the foamable particles B (a powder including a large number of foamable particles B) were obtained. The foamable particles B included silica particles, which were the base particles, and the coat layers. Through a reaction between a 3-chloropropylene group from the 3-chloropropyltrimethoxysilane and the sodium azide, a 3-azidopropylene group was formed. The coat layers of the foamable particles B therefore included the 3-azidopropylene group. That is, the coat layers of the foamable particles B included an azido group as a foamable group. The azido group as a foamable group was chemically bonded to the surfaces of the base particles through the specific bond.

(Foamable Particles C)

A reaction vessel equipped with a stirrer was charged with 100 g of positively chargeable silica particles ("AEROSIL (registered Japanese trademark) REA90", product of Nippon Aerosil Co., Ltd., dry silica particles made positively chargeable through surface treatment, number average primary particle diameter: approximately 20 nm), 9 g of 2,2'-azobis(N-butyl-2-methylpropionamide) (product of Wako Pure Chemical Industries, Ltd.), and 300 mL of tetrahydrofuran, and the reaction vessel contents were stirred at room temperature for 30 minutes. Next, the tetrahydrofuran was subjected to reduced pressure evaporation at room temperature under stirring. As a result, the foamable particles C (a powder including a large number of foamable particles C) were obtained. The foamable particles C included silica particles, which were the base particles, and the coat layers. The coat layers contained the 2,2'-azobis(N-butyl-2-methylpropionamide) having a foamable group. However, the 2,2'-azobis(N-butyl-2-methylpropionamide) merely solidified while penetrating into the surfaces of the base particles instead of being chemically bonded to the surfaces of the base particles through a covalent bond (for example, the specific bond).

<Toner Core Formation Process>

An FM mixer (product of Nippon Coke & Engineering Co., Ltd.) was used to mix 100 parts by mass of a polyester resin, 5 parts by mass of a colorant (ingredient: copper phthalocyanine pigment, color index: Pigment Blue 15:3), 5 parts by mass of an ester wax ("NISSAN ELECTOL (registered Japanese trademark) WEP-9", product of NOF Corporation), and 2 parts by mass of a charge control agent (nigrosine dye: "BONTRON (registered Japanese trademark) N-71", product of ORIENT CHEMICAL INDUSTRIES, Co., Ltd.) to obtain a mixture. A mixture obtained by mixing a low viscosity polyester resin (product of Kao Corporation, Tg: 38° C., Tm: 65° C.), a medium viscosity polyester resin (product of Kao Corporation, Tg: 53° C., Tm: 84° C.), and a high viscosity polyester resin (product of Kao Corporation, Tg: 71° C., Tm: 120° C.) at a mass ratio of 11:9:2 (low viscosity polyester resin:medium viscosity polyester resin:high viscosity polyester resin) was used as the polyester resin. The mixture obtained using the FM mixer was melt-kneaded at 80° C. using a twin-screw extruder ("PCM-30", product of Ikegai Corp.) to obtain a kneaded product. The kneaded product was cooled, and then pulverized using a pulverizer ("TURBO MILL", product of FREUND-TURBO CORPORATION) to obtain a pulverized product. The pulverized product was classified using a classifier (an air classifier using the Coanda effect: "ELBOW JET TYPE EJ-LABO", product of Nittetsu Mining Co., Ltd.) to obtain toner cores. The thus obtained toner cores had a volume median diameter ($D_{50}$) of 6 μm.

<Composite Core Formation Process>

(Preparation of Composite Cores for Toner TA-1)

The foamable particles B were caused to adhere to the surfaces of the toner cores by mixing 100.0 parts by mass of the toner cores and 2.0 parts by mass of the foamable particles B for 5 minutes using an FM mixer (product of Nippon Coke & Engineering Co., Ltd.) having a capacity of 10 L to obtain a powder. The powder was sifted using a 200-mesh sieve (pore size: 75 μm). Thus, composite cores for the toner TA-1 were obtained. The amount of the foamable particles B in the composite cores for the toner TA-1 relative to mass of the toner cores was 2.0% by mass (specifically, 100×2.0/100.0).

(Preparation of Composite Cores for Toners TA-2 to TA-6 and TB-1 to TB-8)

Composite cores for the toners TA-2 to TA-6 and TB-1 to TB-8 were prepared according to the same method as the preparation of the composite cores for the toner TA-1 in all aspects other than the following changes. The particles as shown in Table 1 (the non-foamable particles A, the foamable particles B, or the foamable particles C) were used in the preparation of the composite cores for the toners TA-2 to TA-6 and TB-1 to TB-8, while the foamable particles B were used in the preparation of the composite cores for the toner TA-1. The particles (the non-foamable particles A, the foamable particles B, or the foamable particles C) were used in such amounts as to give the respective amounts shown in Table 1 in the preparation of the composite cores for the toners TA-2 to TA-6 and TB-1 to TB-8, while the amount of the foamable particles B relative to mass of the toner cores was 2.0% by mass in the preparation of the composite cores for the toner TA-1.

For example, in the preparation of the composite cores for the toner TA-2, 1.7 parts by mass of the foamable particles B were used instead of 2.0 parts by mass of the foamable particles B. For another example, in the preparation of the composite cores for the toner TB-3, 1.7 parts by mass of the non-foamable particles A were used instead of 2.0 parts by mass of the foamable particles B. For another example, in the preparation of the composite cores for the toner TB-8, 0.5 parts by mass of the foamable particles C were used instead of 2.0 parts by mass of the foamable particles B.

<Shell Layer Formation Process>

A three-necked flask having a capacity of 2 L and equipped with a thermometer and a stirring impeller was set up in a water bath, and 300 mL of ion exchanged water was added into the flask. Thereafter, the internal temperature of the flask was kept at 30° C. using the water bath. Subsequently, 50 g of an aqueous solution of an oxazoline group-containing polymer ("EPOCROS (registered Japanese trademark) WS-300", product of Nippon Shokubai Co., Ltd., mass ratio of monomers:methyl methacrylate/2-vinyl-2-oxazoline=1/9, solids concentration: 10% by mass) was added into the flask. The flask contents were sufficiently stirred. Subsequently, 300 g of the composite cores (the composite cores for a specified one of the toners TA-1 to TA-6 and TB-1 to TB-8) were added into the flask, and the flask contents were stirred at a rotational speed of 200 rpm for 1 hour. Thereafter, 300 mL of ion exchanged water was added into the flask.

Subsequently, 6 mL of a 1% by mass aqueous ammonia solution was added into the flask. Subsequently, the internal temperature of the flask was increased up to 60° C. at a rate of 0.5° C./minute while the flask contents were stirred at a rotational speed of 150 rpm.

After the internal temperature of the flask reached 60° C., the internal temperature of the flask was kept at 60° C. for 1 hour while the flask contents were stirred at a rotational speed of 100 rpm. Once the internal temperature of the flask had been kept at 60° C. for 1 hour, 10 mL of a 1% by mass aqueous acetic acid solution was added into the flask. Next, the internal temperature of the flask was kept at 60° C. for 30 minutes while the flask contents were stirred at a rotational speed of 100 rpm.

Subsequently, the flask contents were adjusted to pH 7 through addition of a 1% by mass aqueous ammonia solution into the flask. Subsequently, the flask contents were cooled to standard temperature (approximately 25° C.) to obtain a dispersion containing toner mother particles.

<Washing Process>

The toner mother particle-containing dispersion obtained through the shell layer formation process was filtered using a Buchner funnel (solid-liquid separation) to collect a wet cake of the toner mother particles. Thereafter, the resultant wet cake of the toner mother particles was dispersed in ion exchanged water. Furthermore, dispersion and filtering were repeated five times to wash the toner mother particles.

<Drying Process>

The toner mother particles obtained through the washing process were dried using a continuous type surface modifier ("COATMIZER" (registered Japanese trademark)", product of Freund Corporation) under conditions of a hot air flow temperature of 45° C. and a blower flow rate of 2 $m^3$/minute. As a result, a powder of the dried toner mother particles was obtained.

<External Additive Addition Process>

An external additive was added to the toner mother particles obtained through the drying process. Specifically, 100 parts by mass of the toner mother particles (powder) and 1 part by mass of positively chargeable silica particles ("AEROSIL (registered Japanese trademark) REA90", product of Nippon Aerosil Co., Ltd., content: dry silica particles made positively chargeable through surface treatment, number average primary particle diameter: 20 nm) were mixed for 5 minutes using an FM mixer (product of Nippon Coke & Engineering Co., Ltd.) having a capacity of 10 L. Through the above, the external additive (the silica particles) was caused to adhere to the surfaces of the toner mother particles to obtain a powder. The resultant powder was sifted using a 200-mesh sieve (pore size: 75 μm). Thus, each of the toners (the toners TA-1 to TA-6 and TB-1 to TB-8) was obtained.

[Measurement Method]

With respect to each of the toners TA-1 to TA-6 and TB-1 to TB-8 obtained as described above, the first foaming amount, the second foaming amount, the third foaming amount, and the ratio $V_{4B}/V_{4A}$ were measured. Measurement methods thereof were as described below. Measurement results of the first foaming amount, the second foaming amount, and the third foaming amount were as shown in Table 1. Measurement results of the ratio $V_{4B}/V_{4A}$ were as shown in Table 2.

<Measurement Method of First Foaming Amount (First Method)>

With respect to each of the toners TA-1 to TA-6 and TB-1 to TB-8, 100 g of the toner (measurement target) and 100 mL of silicone oil ("KF-96", product of Shin-Etsu Chemical Co., Ltd.) were added into a separable flask having a capacity of 300 mL and equipped with a thermometer and a stirrer (a stirring impeller). Subsequently, the flask was set up in an oil bath at 30° C. Next, a device for collecting gas generated in the liquid in the flask over the liquid (also referred to below as a "gas collection device") was attached to the flask. The gas collection device was equipped with a collection container for collecting gas generated by the flask contents. The oil bath was controlled so that the collection container and the flask were at the same temperature. Subsequently, the flask contents were heated up to 120° C. at a rate of 1° C./minute using the oil bath under stirring at a stirring impeller rotational speed of 100 rpm. After completion of the heating, the flask contents were kept at 120° C. for 30 minutes under stirring at a stirring impeller rotational speed of 100 rpm. The volume $V_1$ of gas in the collection container was measured once 30 minutes elapsed after the temperature of the flask contents had reached 120° C. (referred to below as a time X). The volume $V_1$ of gas in the collection container was equivalent to the volume of gas collected over the liquid during a period from when the heating was started at 30° C. to when 30 minutes elapsed after the temperature of the flask contents had reached 120° C. The volume $V_1$ of gas measured at the time X was taken to be the first foaming amount.

<Measurement Method of Second Foaming Amount (Second Method)>

With respect to each of the toners TA-1 to TA-6 and TB-1 to TB-8, 1 g of the toner (measurement target) and 100 mL of toluene were added into a separable flask having a capacity of 300 mL. The flask contents were stirred at room temperature and a stirring rate of 100 rpm for 2 hours to obtain a liquid. The resultant liquid was centrifuged using a centrifuge ("AVANTI JXN-26", product of Beckman Coulter, Inc.) at room temperature and a rotational speed of 5,000 rpm for 20 minutes. After the centrifugation, a solid phase was collected from the liquid. The solid phase was dried at room temperature to obtain toluene-insoluble matter. The resultant toluene-insoluble matter was equivalent to toluene-insoluble matter that is obtained from 1 g of the toner.

The volume $V_{2A}$ of gas in the collection container was measured at the time X according to the same method as the measurement method of the first foaming amount in all aspects other than that the entire amount of the toluene-insoluble matter obtained from 1 g of the toner was added into the separable flask instead of 100 g of the toner. The volume $V_{2A}$ of gas is equivalent to the volume of gas generated from the toluene-insoluble matter contained in 1 g of the toner. The volume $V_2$ of gas, which is 100 times the volume $V_{2A}$ of gas, was calculated in accordance with an expression "$V_2=V_{2A}\times100$", and the volume $V_2$ of gas was taken to be the second foaming amount. The second foaming amount is equivalent to the volume of gas generated from the toluene-insoluble matter contained in 100 g of the toner.

<Measurement Method of Third Foaming Amount (Third Method)>

With respect to each of the toners TA-1 to TA-6 and TB-1 to TB-8, 10 g of the toner (measurement target) and 200 mL of tetrahydrofuran were added into a separable flask having a capacity of 300 mL. The flask contents were stirred at room temperature and a stirring rate of 100 rpm for 24 hours to obtain a liquid. Tetrahydrofuran-insoluble matter was removed from the liquid by gel filtration column chromatography to obtain a solution of tetrahydrofuran-soluble matter. The gel filtration column chromatography was performed using an open column ("CHROMATOGRAPHIC TUBE" sold by AS ONE Corporation, a chromatographic tube with a filter and a glass stopcock, internal diameter: 30 mm), bio beads ("SM-2", product of Bio-Rad Laboratories, Inc., a nonpolar polystyrene adsorbent, bead size: 180 μm, average pore size: 90 Å, surface area: 300 $m^2$/g, wet density: 1.02 g/mL) as a filler, and tetrahydrofuran as a developing solvent. The resultant solution of tetrahydrofuran-soluble matter was subjected to reduced pressure evaporation to collect the tetrahydrofuran-soluble matter. The collected tetrahydrofuran-soluble matter was equivalent to tetrahydrofuran-soluble matter that is obtained from 10 g of the toner.

The volume $V_{3A}$ of gas in the collection container was measured at the time X according to the same method as the measurement method of the first foaming amount in all aspects other than that the entire amount of the tetrahydrofuran-soluble matter obtained from 10 g of the toner was added into the separable flask instead of 100 g of the toner. The volume $V_{3A}$ of gas is equivalent to the volume of gas generated from the tetrahydrofuran-soluble matter contained in 10 g of the toner. The volume $V_3$ of gas, which is 10 times the volume $V_{3A}$ of gas, was calculated in accordance with an expression "$V_3=V_{3A}\times10$", and the volume $V_3$ of gas was taken to be the third foaming amount. The third foaming amount is equivalent to the volume of gas generated from the tetrahydrofuran-soluble matter contained in 100 g of the toner.

<Measurement Method of Ratio $V_{4B}/V_{4A}$ (Fourth Method)>

(Measurement of Pre-Extraction Gas Volume $V_{4A}$)

The volume of gas in the collection container was measured at the time X according to the same method as the measurement method of the first foaming amount in all aspects other than that 100 g of the foamable particles B were added into the separable flask instead of 100 g of the toner. The thus measured volume of gas was taken to be the pre-extraction gas volume $V_{4A}$.

(Measurement of Post-Extraction Gas Volume $V_{4B}$)

A Soxhlet extractor was charged with 100 g of the foamable particles B and 200 mL of tetrahydrofuran, and extraction was performed at 75° C. for 18 hours. Next, the foamable particles B subjected to extraction with tetrahydrofuran were collected and subjected to reduced pressure drying at room temperature. The volume of gas in the collection container was measured at the time X according to the same method as the measurement method of the first foaming amount in all aspects other than that the entire amount of the foamable particles B subjected to extraction with tetrahydrofuran were added into the separable flask instead of 100 g of the toner. The thus measured volume of gas was taken to be the post-extraction gas volume $V_{4B}$.

(Calculation of Ratio $V_{4B}/V_{4A}$)

The ratio (unit: % by volume) of the post-extraction gas volume $V_{4B}$ to the pre-extraction gas volume $V_{4A}$ was calculated for the foamable particles B in accordance with the expression "$100\times V_{4B}/V_{4A}$".

The ratio $V_{4B}/V_{4A}$ was calculated for the non-foamable particles A according to the same method as described above in all aspects other than that the non-foamable particles A were used instead of the foamable particles B. The ratio $V_{4B}/V_{4A}$ was calculated for the foamable particles C according to the same method as described above in all aspects other than that the foamable particles C were used instead of the foamable particles B. The foamable particles having a ratio $V_{4B}/V_{4A}$ of at least 90% by volume were determined to be foamable particles in which most of the molecules of the foamable group were bonded to the surfaces of the base particles through a chemical bond (for example, the specific bond). Measurement results of the ratio $V_{4B}/V_{4A}$ are shown in Table 2.

The symbol "–" in Table 1 indicates that the percentage of the second foaming amount relative to the first foaming amount, and the percentage of the third foaming amount relative to the first foaming amount were not calculable because the first foaming amount $V_1$, the second foaming amount $V_2$, and the third foaming amount $V_3$ were each 0.0 mL/100 g. The symbol "—" for the non-foamable particles A in Table 2 indicates that the ratio $V_{4B}/V_{4A}$ was not calculable because the non-foamable particles A had no foamable group, and therefore the pre-extraction gas volume $V_{4A}$ and the post-extraction gas volume $V_{4B}$ were each 0 mL.

[Evaluation Method]

Each of the samples (the toners TA-1 to TA-6 and TB-1 to TB-8) was evaluated according to methods described below.

(Low-Temperature Fixability)

Low-temperature fixability of each of the toners TA-1 to TA-6 and TB-1 to TB-8 having the shell layers was evaluated. Specifically, a minimum fixable temperature of the evaluation target toner was measured and compared with a minimum fixable temperature of the same toner in which the foamable or non-foamable particles and the shell layers had been omitted (also referred to below as a "toner including toner cores having no particles and no shell layers"). Low-temperature fixability of the evaluation target toner was evaluated based on the comparison. The toner including toner cores having no particles and no shell layers was obtained by performing the above-described external additive addition process on the toner cores without performing the composite core formation process, the shell layer formation process, the washing process, and the drying process. For example, the toner TA-1 in which the foamable particles B and the shell layers were omitted (the toner including toner cores having no particles and no shell layers) was obtained by performing the above-described external additive addition process on the toner cores. The following describes a method for measuring the minimum fixable temperature of the evaluation target toner.

(Preparation of Evaluation Developer)

With respect to each of the toners TA-1 to TA-6 and TB-1 to TB-8, the toner (evaluation target) and a developer carrier (a carrier for "TASKalfa5550ci", product of KYOCERA Document Solutions Inc.) were mixed using a ball mill for 30 minutes under environmental conditions of a temperature of 25° C. and a relative humidity of 50% to prepare an evaluation developer (a two-component developer). The toner accounted for 12% by mass of the evaluation developer.

An evaluation apparatus obtained by modifying a printer ("FS-C5250DN", product of KYOCERA Document Solutions Inc.) to enable adjustment of fixing temperature was used. The evaluation developer prepared as described above was loaded into a cyan color developing device of the evaluation apparatus, and a toner for replenishment use (the evaluation target among the toners TA-1 to TA-6 and TB-1 to TB-8) was loaded into a cyan color toner container of the evaluation apparatus.

The evaluation apparatus was used to form a solid image (specifically, an unfixed toner image) having a size of 25 mm×25 mm on paper (A4 size plain paper having a basis weight of 90 g/m$^2$) at a toner application amount of 1.0 mg/cm$^2$ under environmental conditions of a temperature of 25° C. and a relative humidity of 50%. Subsequently, the paper with the image (the unfixed toner image) formed thereon was passed through a fixing device of the evaluation apparatus.

The minimum fixable temperature was measured in a fixing temperature range of from 100° C. to 200° C. Specifically, the fixing temperature of the fixing device was gradually increased from 100° C. to determine the lowest temperature at which the solid image (the toner image) was fixable to the paper (minimum fixable temperature). Determination of whether or not the toner was fixable was carried out through a fold-rubbing test. Specifically, the evaluation paper passed through the fixing device was folded with a surface having the image formed thereon facing inward at a folding line crossing a center of the image, and a 1-kg weight covered with cloth was rubbed back and forth on the fold five times. Subsequently, the paper was opened up and a fold portion (a portion on which the solid image was formed) of the paper was observed. Then, the length of toner peeling of the fold portion (peeling length) was measured. The minimum fixable temperature was determined to be the lowest temperature among fixing temperatures for which the peeling length was no greater than 1 mm.

The minimum fixable temperature of the toner including toner cores having no particles and no shell layers was measured in the same manner as in the measurement of the minimum fixable temperature of the evaluation target toner. A difference ($T_1$-$T_2$) between a minimum fixable temperature $T_1$ of the evaluation target toner and a minimum fixable temperature $T_2$ of the same toner in which the foamable or non-foamable particles and the shell layers had been omitted (that is, the "toner including toner cores having no particles and no shell layers") was calculated. Low-temperature fixability was evaluated as "good" if the difference ($T_1$–$T_2$) was less than +10° C., and was evaluated as "poor" if the difference ($T_1$–$T_2$) was greater than or equal to +10° C.

(UFP Yield)

The same evaluation developer and the same evaluation apparatus as in the low-temperature fixability evaluation were used in UFP yield evaluation. With respect to each of the toners TA-1 to TA-6 and TB-1 to TB-8, the evaluation developer and the toner for replenishment use (evaluation target) were loaded into the evaluation apparatus in the same manner as in the low-temperature fixability evaluation. The fixing temperature of the evaluation apparatus was set at 175° C.

The evaluation apparatus was placed in a stainless steel chamber (environmental chamber, capacity: approximately 5 m$^3$), and the chamber was ventilated over 2 hours. Subsequently, the evaluation apparatus was used to perform a printing durability test over 10 minutes under conditions of a fixing temperature of 175° C. and a printing rate of 26 sheets/minute. The number of UFPs that were produced was determined in accordance with an award criterion of the German ecolabel, "The Blue Angel" (specifically, "RAL-UZ171" provided by the German Institute for Quality Assurance and Labeling (RAL)). The number of UFPs was determined using a particle size distribution meter ("Fast Mobility Particle Sizer (FMPS) 3091", product of TSI Incorporated, charging method: unipolar diffusion charging, time resolution: 1 second, sample flow rate: 10 L/minute).

Based on the determination, a number of UFPs of less than $1.0\times10^5$ was evaluated as "good", and a number of UFPs of greater than or equal to $1.0\times10^5$ was evaluated as "not good".

[Evaluation Result]

Table 3 shows the results of the low-temperature fixability evaluation and the UFP yield evaluation on the toners TA-1 to TA-6 and TB-1 to TB-8.

TABLE 3

| | Toner | Low-temperature fixability $T_1$-$T_2$ [° C.] | Evaluation | UFP yield |
|---|---|---|---|---|
| Example 1 | TA-1 | +4 | Good | Good |
| Example 2 | TA-2 | +4 | Good | Good |
| Example 3 | TA-3 | +6 | Good | Good |
| Example 4 | TA-4 | +6 | Good | Good |
| Example 5 | TA-5 | +8 | Good | Good |
| Example 6 | TA-6 | +8 | Good | Good |
| Comparative Example 1 | TB-1 | +11 | Poor | Good |
| Comparative Example 2 | TB-2 | +10 | Poor | Good |
| Comparative Example 3 | TB-3 | +10 | Poor | Good |
| Comparative Example 4 | TB-4 | +10 | Poor | Good |
| Comparative Example 5 | TB-5 | +10 | Poor | Good |
| Comparative Example 6 | TB-6 | +10 | Poor | Good |
| Comparative Example 7 | TB-7 | +10 | Poor | Good |
| Comparative Example 8 | TB-8 | +8 | Good | Not good |

As shown in Table 1, the toner particles of the toners TA-1 to TA-6 each included a composite core and a shell layer covering the surface of the composite core. The composite core was a composite of a toner core containing a binder resin and the foamable particles B provided on the surface of the toner core. The amount of the foamable particles B was greater than or equal to 0.3% by mass relative to mass of the toner cores. As shown in Table 2, the foamable particles B each included a base particle and a coat layer covering the surface of the base particle. The base particles (specifically, silica particles) of the foamable particles B were non-foamable. The coat layers included a foamable group (specifically, an azido group). The foamable group was bonded to the surfaces of the base particles through the specific bond. Consequently, as indicated in Table 3, the toners TA-1 to TA-6 were excellent in low-temperature fixability. Each of the toners TA-1 to TA-6 resulted in a UFP yield of less than $1.0\times10^5$ through the multi-sheet printing using the toner.

By contrast, as for the toner TB-1, the amount of the foamable particles B was less than 0.3% by mass relative to mass of the toner cores as shown in Table 1. Consequently, as shown in Table 3, the toner TB-1 was poor in low-temperature fixability.

As shown in Table 1, the composite cores of the toners TB-2 to TB-7 were each a composite of a toner core and the non-foamable particles A. As shown in Table 2, the coat layers of the non-foamable particles A included no foamable group. Consequently, as indicated in Table 3, the toners TB-2 to TB-7 were poor in low-temperature fixability.

As shown in Table 1, the composite cores of the toner TB-8 were each a composite of a toner core and the foamable particles C. As shown in Table 2, the coat layers of the foamable particles C included a foamable group, but the foamable group was not bonded to the surfaces of the base particles through the specific bond. Accordingly, as indicated in Table 3, the toner TB-8 resulted in a UFP yield of greater than or equal to $1.0\times10^5$ through the multi-sheet printing using the toner.

What is claimed is:

1. A toner comprising toner particles, wherein each of the toner particles includes a composite core and a shell layer covering a surface of the composite core, each of the composite cores is a composite of a toner core and foamable particles provided on a surface of the toner core, an amount of the foamable particles is at least 0.3% by mass relative to mass of the toner cores, each of the foamable particles includes a base particle and a coat layer covering a surface of the base particle, the base particles are non-foamable, the coat layers include a foamable group, and the foamable group is bonded to the surfaces of the base particles through a bond including a bond represented by formula "—O—Si—".

2. The toner according to claim 1, wherein the foamable group is an azido group, and the foamable particles generate nitrogen through an exothermic reaction of the azido group.

3. The toner according to claim 1, wherein the coat layers include a structure represented by formula (1) shown below, (1)

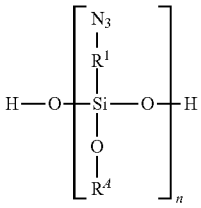

where in formula (1), $R^1$ represents an alkylene group, n represents a repeating number of a repeating unit in the structure, and $R^A$ represents a bond bonded to an atom composing the base particles.

4. The toner according to claim 1, wherein the base particles are silica particles.

5. The toner according to claim 1, wherein the foamable particles are not located inside of the toner cores, and the foamable particles are not located on outermost surfaces of the toner particles.

* * * * *